United States Patent [19]

Groothoff et al.

[11] 3,934,169

[45] Jan. 20, 1976

[54] PICTURE DISPLAY DEVICE AND DEFLECTION COIL BOTH HAVING SELF-ALIGNING SURFACES

[75] Inventors: Adriaan Jacob Groothoff; Martin Clemens van der Heijde; Johannes Aloysius Van Leeuwen; Constantius Johannes Waltherus Panis, all of Eindhoven, Netherlands

[73] Assignee: U.S. Philips Corporation, New York, N.Y.

[22] Filed: Nov. 9, 1973

[21] Appl. No.: 414,376

[30] Foreign Application Priority Data

Aug. 20, 1973 Netherlands ..... 7311430

[52] U.S. Cl. ..... 313/477; 313/160; 313/317; 313/425; 313/440

[51] Int. Cl.[2] ..... H01J 63/02; H01J 29/54

[58] Field of Search ..... 178/7.8; 313/75, 76, 79, 313/160, 162, 317, 49, 412, 425, 440, 477, 482; 335/210, 212, 214

[56] References Cited

UNITED STATES PATENTS

| | | | |
|---|---|---|---|
| 2,354,661 | 8/1944 | Berejkoff | 313/440 X |
| 2,986,667 | 5/1961 | Tirico | 313/440 |
| 3,163,794 | 12/1964 | Bloomsburgh et al. | 335/210 |
| 3,410,955 | 11/1968 | Mackey | 313/75 X |
| 3,566,321 | 2/1971 | Brown, Jr. | 313/75 X |
| 3,663,751 | 5/1972 | Oberg et al. | 178/7.8 |

*Primary Examiner*—Harold A. Dixon
*Assistant Examiner*—E. R. La Roche
*Attorney, Agent, or Firm*—Frank R. Trifari; Henry I. Steckler

[57] ABSTRACT

In a picture display tubes having deflection angles of 110° and more the conical central part near the transition to the neck has a substantially flat variation perpendicular to the tube axis. As a result of this an accurate positioning of the deflection device on the display tube is seriously hampered. This problem is solved by centering members which are present on the conical central part and which cooperate in a self-centering manner with centering members forming part of the supporting cage of the deflection device. The position of the deflection device in the axial direction is accurately fixed by abutment members forming part of the supporting cage in co-operation with abutment surfaces forming part of the envelope of the tube.

11 Claims, 4 Drawing Figures

PICTURE DISPLAY DEVICE AND DEFLECTION COIL BOTH HAVING SELF-ALIGNING SURFACES

Figure 1:
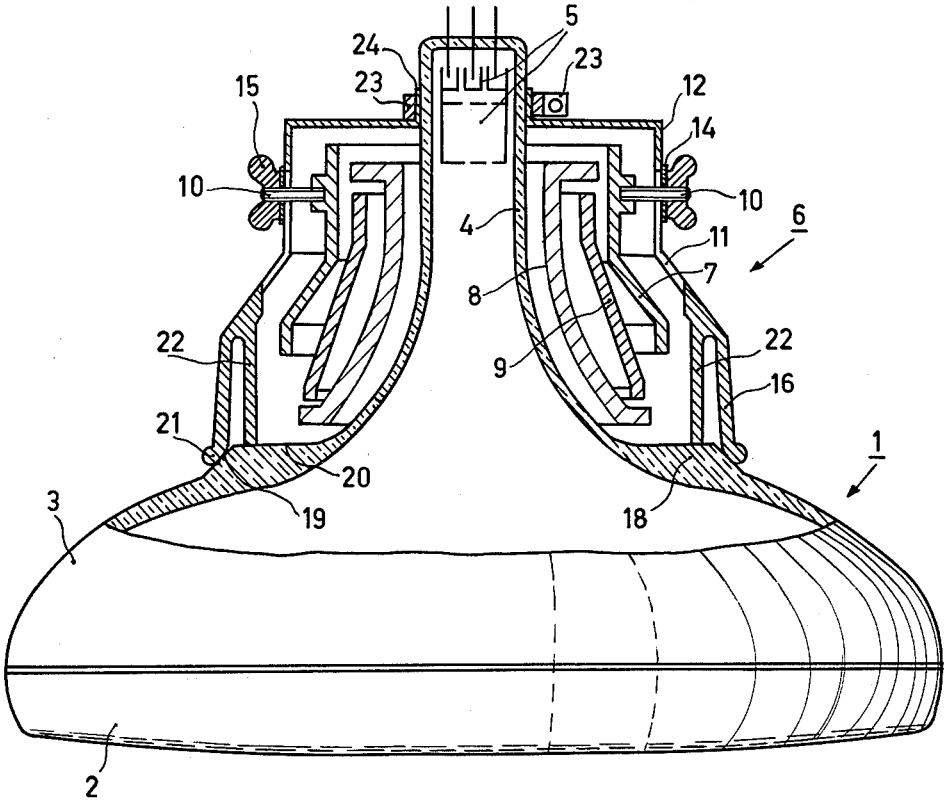

The invention relates to a picture display device comprising a picture display tube whose envelope is formed by a conical central part which is closed by a display screen at its wide end and which changes, at the narrow end, into a tubular neck which is closed at its free end, in which neck an electrode system is present to generate at least one electron beam, on which envelope a system of deflection coils arranged coaxially around the tube is mounted near the transition from neck and cone and secured in a supporting cage, for which purpose the envelope comprises on its conical central part means to centre the said supporting cage.

Such a picture display device is known from the U.S. Pat. No. 2,354,661.

The development of picture display tubes has of late years bean considerably directed to the construction of display tubes having smaller and smaller dimensions in the axial direction. For that purpose, the electron beam or beams generated in an electrode system are deflected over an ever increasing angle. Starting with a deflection angle of 70°, said development has continued via a deflection angle of 90° to the nowadays usual construction having a deflection angle of 110°. The problems associated with this development, however, do not only relate to the construction of the deflection coils themselves, but also to the connection of the supporting cage thereof on the envelope of the display tube. As the deflection angle is made larger, more stringent requirements are imposed upon the accuracy with which the system of deflection coils can be positioned relative to the optical axis of the electrode system present within the neck of the tube. In particular in the case of color television display tube it is of importance that the central axis of the system of deflection coils coincides as accurately as possible with the said optical axis so as to minimize colour defects as a result of mislandings of an electron beam on the display screen.

In the usual connection, the supporting cage is slid over the neck of the tube until a supporting ring forming part of the supporting cage engages the conical central part. The supporting cage is clamped on the rear side on the neck of the tube by means of a clamping band.

Since in tubes having a deflection angle of 110° the conical central part near the transition to the neck has a substantially flat variation at right angles to the axis of the tube, an accurate positioning of the supporting cage at the area where it engages the said conical central part is seriously hampered.

In the picture display device known from the said U.S. patent specification the cathode-ray tube described therein which otherwise has a comparatively small deflection angle shows a cylindrical part at the area of the centre of gravity of the tube around which means are provided to support the tube during mounting thereof in a cabinet. For that purpose, the said cylindrical part has screwthread or a flange which may be moulded in the glass and on which the supporting cage of the system of deflection coils is also screwed or secured by means of bolts. Such a way of connection is not easy to control and hardly ensures an accurate positioning of the system of deflection coils since for each of the members required for said connection an accurate positioning and precision is required.

It is the object of the invention to provide a picture display device of the type mentioned in the preamble in which the said problems are solved in a simple and efficacious manner.

For that purpose, a picture display device according to the invention is characterized in that the means for centering the supporting cage present on the conical central part cooperate in a self-centering manner with centering members forming part of the supporting cage. According to the invention, said self-centering effect may start either from the centering means present on the conical central part, or from the centering members forming part of the supporting cage. In the former case, according to the invention the said centering means consist of a conical centering edge which forms one assembly wiht the conical central part and is present coaxially around the tube axis. In the latter case, according to the invention the centering members forming part of the supporting cage consist of cams which have centering faces which are present on a surface which is conical relative to the tube axis. Said cams then cooperate with a centering edge which forms one assembly with the conical central part and which in this case need consequently not be conical.

In both above cases, according to the invention, the said centering edge may be interrupted so that a number of centering cams are obtained. The embodiment having a non-interrupted centering edge, however, is to be preferred since in that case the matrix for the conical central part is simpler to manufacture.

According to a particularly favorable embodiment the conical central part of the tube according to the invention has an axial abutment for the supporting cage present in a plane perpendicular to the tube, namely for abutment members present on the supporting cage, in the form of an abutment edge or a number of abutment cams. According to the invention, the said axial abutment preferably consists of an end face which bounds the centering edge on the side facing the neck of the tube.

In the above-described favorable embodiment the supporting cage according to the invention comprises on its side facing the display screen a supporting edge which preferably forms a polygon in cross-section. The centers of the sides of said supporting edge is cooperation with a conical centering edge on the envelope deviate resiliently in the radial direction until the abutment members of the supporting cage bear on the axial abutment.

In the case of a non-conical centering edge, according to the invention the supporting edge of the supporting cage has self-centering cams. These are present on the inside of the supporting edge, namely on the centers of the sides thereof.

When self-centering cams are present on the inner wall of a known circular cylindrical supporting edge, according to the invention said supporting edge has incisions which extend in the axial direction on either side of said cams so as to obtain the said resilient action.

In the two above-described cases of cams on the supporting edge, according to the invention said cams may form one assembly with the above-mentioned abutment members.

The invention ensures a readily defined and very accurate position of the supporting cage on the envelope of a picture display tube. The manner of securing is very reproducible and is excellently suitable for use in picture display devices for color television. As already noted, an accurate position of the system of deflection coils is an indispensable requirement in this application. The invention is particularly suitable when used in a picture display device for color television the picture display tube of which comprises an electrode system which generates three electron beams which are present substantially in one plane. In such a system, as is known, means for a dynamic convergence of the electron beams may be omitted. A condition in that case is, however, that the system of deflection coils for the said three beams is very accurately positioned relative to the electron optical axis so as to compensate for the lack of electric correction means.

It is to be noted that it is known to use in such a picture display tube for the connection of the deflection device a ring which is cemented to the conical central part (see I.E.E.E. Transactions on Broadcast and Television Receivers, 1972, Volume BTR-18, Nr. 3, pp. 193-200). Said ring has projections which project with ample play through recesses provided in the supporting cage. After providing the deflection device in the desired position, the recesses are filled with a thermoplastic material and the deflection device is permanently secured to the tube. In this case there is no question of a self-centering ring. Such a manner of connection presents problems in a possible repair of the tube while readjustment of the deflection device can be carried out with difficulty only.

Figure 2:
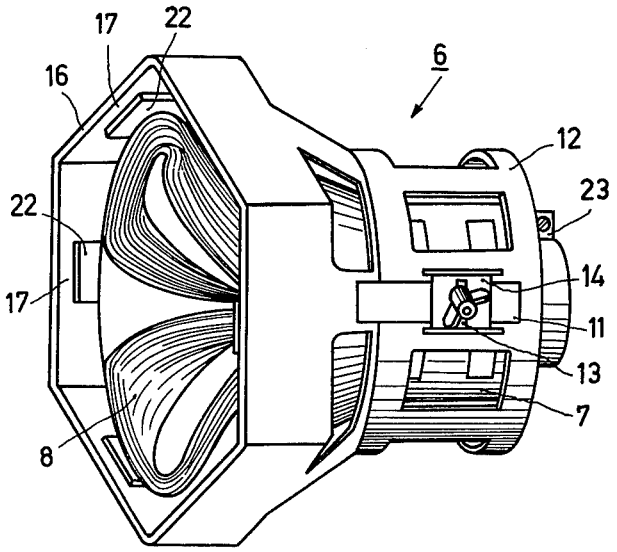
Figure 3:
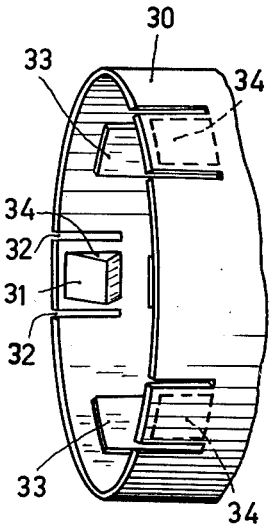
Figure 4:
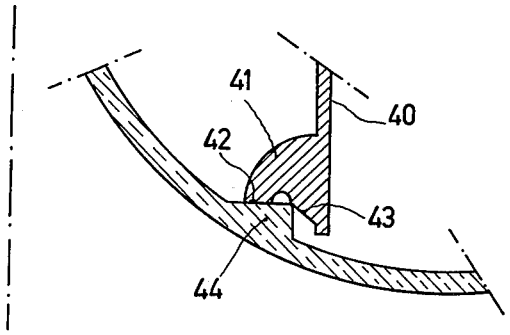

The invention will be described in greater detail with reference to a drawing, in which FIG. 1 is a partial cross-sectional view of an embodiment according to the invention, FIG. 2 is a perspective view of the deflection device shown in FIG. 1, FIG. 3 shows an embodiment of a circular cylindrical supporting edge, and FIG. 4 shows another embodiment of a supporting edge in cooperation with a non-conical centering edge.

The device shown in FIG. 1 consists inter alia of a color television display tube 1, the envelope of which is formed by a display screen 2, a conical central part 3 and a neck 4. An electrode system 5, shown diagrammatically, for generating three electron beams located in one plane is present in the neck 4. Said beams on their way to the display screen 2 are deflected by a magnetic field generated by a deflection device 6 secured to the tube. For that purpose, said deflection device comprises a system of deflection coils which is secured on an inner cage 7 of a synthetic material and which consists of a number of deflection coils 8 and an annular core 9 which are shown diagrammatically in FIG. 1. The inner cage 7 has studs 10 which project through holes 11 in the supporting cage 12 of synthetic material. The holes 11 are elongated in the axial direction. The studs 10 also project through holes 13 which are elongated in the radial direction and are provided in the closing plates 14 (see FIG. 2). So relative to the supporting cage 12, the inner cage 7 can be moved along its longitudinal direction and be rotated thereabout. By tightening the wingnuts 15, the inner cage is secured relative to the supporting cage.

As is obvious from FIG. 2, the supporting cage has a hexagonal supporting ring 16 of which the centers of the sides which are denoted by 17 cooperate with a conical centering edge 18. Said centering edge is bounded externally by a curved centering surface 19 and an end face 20 which is present in a plane perpendicular to the tube axis. The curved surface 19 and the end face 20 intersect each other at an angle of 100°. (This angle is not critical but is preferably chosen to be between 100° and 130°). The end face 20 forms an axial abutment for the supporting cage 12, namely for a number of abutment members 22 thereof. (Although six abutment members are shown, said three are already sufficient).

Upon assembling, the deflection device 6 is slid over the tube neck 4 until the centers of the sides of the hexagonal supporting edge 16 which are denoted by 17 bear on the curved centering surface 19. The side of the deflection device remote from the display screen is centered on the neck of the tube by means of a guide 24 which forms part of the supporting cage. The side of the deflection device facing the display screen is now centred by moving the supporting edge further in the direction of the display screen. The centres 17 of the sides of the supporting edge 16 are slightly forced outwardly radially by the curved centring surface 19, as is denoted by 21. In this stage of the assembly, the deflection device is accurately centred relative to the tube axis by the self-centering action of the curved surface 19. The position in the axial direction is fully established by the abutment members 22 in cooperation with the end face 20 of the centering edge 18. The clamping band 23 provided around the guide 24 is now tightened so that the deflection device 6 is accurately centered on the display tube 1.

FIGS. 3 and 4 show two embodiments in the case in which the centering edge present on the conical central part of the tube is not conical. In FIG. 3 the circular cylindrical supporting edge 30 has centering cams 34 with centering surfaces 31 present on a conical surface relative to the tube axis. On either side of the cams 34 the supporting edge 30 has incisions 32 which extend in the axial direction and which permit of a deviation of the cams 34 in the radial direction. The abutment members 33 are shown individually but, as shown in FIG. 4, they may also form one assembly with the centering cams. The centering cams 41 cooperate with the non-conical centering edge 44 and have centering surfaces 43 and abutment faces 42. The supporting edge 40 in cross-section may be either a polygon or a circle.

In the axial direction the position of the supporting cage is fully determined by a centering edge (18, 44) forming one assembly with the conical central part. Said centering edge may serve as a common reference both during the positioning of the system of deflection coils and that of, for example, the electrode system in the neck of the tube. Such a common reference increases the accuracy in the positioning of the components mutually.

We claim:

1. A picture display device tube having a longitudinal axis and comprising a conical central part, a neck mounted on said central part, means for generating at least one electron beam disposedin said neck, and means disposed on said central part for self centering a deflection coil supporting cage with respect to the longitudinal axis of said tube, the said centering means comprising a centering edge integrally formed with the conical central part of the tube and which is disposed coaxially around the longitudinal axis of the tube, the centering edge having a centering surface which is conical relative to the longitudinal axis, the angle enclosed by the centering surface of the centering edge and the longitudinal axis is smaller than the angle enclosed by the one surface at the area of the centering edge and the longitudinal axis.

2. A picture display device as claimed in claim 1, wherein the said centering edge is interrupted.

3. A picture display device as claimed in claim 1, wherein the picture display tube is a color television display tube, and said generating means comprises means for generating three electron beams which are disposed in a substantially common plane near said generating means.

4. A picture display device as claimed in claim 1, wherein the conical central part of the tube has an abutment means for the supporting cage disposed in a plane substantially perpendicular to the tube axis.

5. A picture display device as claimed in claim 4, wherein the said axial abutment means comprises an end face which bounds the centering edge on its side facing the neck of the tube.

6. A deflection coil device for a picture display tube having a longitudinal axis and a conical central part with a centering edge, said device comprising a supporting cage, a system of deflection coils mounted on said cage, and radially resilient centering member means disposed on said cage for self centering said coils on said centering edge with respect to the longitudinal axis of said tube.

7. A device as claimed in claim 6, wherein the supporting cage has an annular portion and means disposed in said annular portion for cooperating with axial abutment means on the tube.

8. A device as claimed in claim 6 in which the supporting cage on its side facing the tube display screen has a supporting edge, said supporting edge in cross-section comprises a polygon.

9. A device as claimed in claim 6 in which the supporting cage on its side facing the tube display screen has a supporting edge having an inside facing said longitudinal axis, the supporting edge having centering cams on said inside.

10. A device as claimed in claim 9, wherein the supporting edge on either side of each cam has incisions which extend substantially in the longitudinal direction.

11. A device as claimed in claim 9, wherein the said centering cams also comprise the abutment members which cooperate with the tube axial abutment means.

* * * * *

UNITED STATES PATENT AND TRADEMARK OFFICE

CERTIFICATE OF CORRECTION

PATENT NO. : 3,934,169

DATED : January 20, 1976

INVENTOR(S) : ADRIAAN JACOB GROOTHOFF ET AL

It is certified that error appears in the above-identified patent and that said Letters Patent are hereby corrected as shown below:

IN THE CLAIMS

Claim 1, col. 5, line 1, cancel "one" and insert -- cone --;

Signed and Sealed this

Thirteenth Day of July 1976

[SEAL]

*Attest:*

RUTH C. MASON
*Attesting Officer*

C. MARSHALL DANN
*Commissioner of Patents and Trademarks*